US011286135B2

(12) United States Patent
Turek et al.

(10) Patent No.: US 11,286,135 B2
(45) Date of Patent: Mar. 29, 2022

(54) BELT-DRIVEN ESCALATOR

(71) Applicant: Otis Elevator Company, Farmington, CT (US)

(72) Inventors: Alexander Turek, Münchendorf (AT); Thomas Illedits, Neufeld an der Leitha (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/091,947

(22) Filed: Nov. 6, 2020

(65) Prior Publication Data

US 2021/0139287 A1 May 13, 2021

(30) Foreign Application Priority Data

Nov. 8, 2019 (EP) ..... 19208054

(51) Int. Cl.

| | |
|---|---|
| ***B66B 21/04*** | (2006.01) |
| ***B66B 23/02*** | (2006.01) |
| ***B66B 23/12*** | (2006.01) |
| ***B66B 23/14*** | (2006.01) |

(52) U.S. Cl.

CPC ..... *B66B 21/04* (2013.01); *B66B 23/02* (2013.01); *B66B 23/12* (2013.01); *B66B 23/14* (2013.01)

(58) Field of Classification Search

CPC ..... B66B 23/02; B66B 21/04; B66B 23/12; B66B 23/14; B66B 23/026; B66B 23/028

USPC ..... 198/330

See application file for complete search history.

(56) References Cited

U.S. PATENT DOCUMENTS

| | | | | |
|---|---|---|---|---|
| 3,365,051 A * | 1/1968 | Mullis | B66B 23/147 198/833 |
| 3,669,238 A | 6/1972 | Folkes et al. | |
| 3,967,720 A * | 7/1976 | Arieh | B65G 23/16 198/833 |
| 5,224,580 A * | 7/1993 | Nurnberg | B66B 23/026 198/330 |
| 5,755,315 A * | 5/1998 | Wallbaum | B66B 23/04 198/330 |
| 6,540,060 B1 * | 4/2003 | Fargo | B66B 23/02 198/326 |

(Continued)

FOREIGN PATENT DOCUMENTS

| | | | |
|---|---|---|---|
| CN | 110040615 * | 7/2019 | B66B 21/10 |
| EP | 1440031 A1 | 7/2004 | |

(Continued)

OTHER PUBLICATIONS

European Search Report for Application No. 19208054.7; dated May 28, 2020; 5 Pages.

*Primary Examiner* — James R Bidwell
(74) *Attorney, Agent, or Firm* — Cantor Colburn LLP

(57) ABSTRACT

A belt-driven escalator 2 is provided that includes a plurality of escalator steps 4 arranged to travel along an inclined conveyance path 101; a drive belt 10, 1010 connected to the plurality of escalator steps 4; a drive system 24 arranged to drive the drive belt 10, 1010 so as to propel the plurality of escalator steps 4 along the inclined conveyance path 101; and a belt support structure 22, 1022 including at least one belt wheel 206, 1206 arranged to support the drive belt 10, 1010 so as to support the plurality of escalator steps 4.

9 Claims, 12 Drawing Sheets

(56) References Cited

U.S. PATENT DOCUMENTS

| | | | | |
|---|---|---|---|---|
| 7,219,784 | B2 * | 5/2007 | Fargo | B66B 23/02 198/326 |
| 2006/0054458 | A1 * | 3/2006 | Meyer | B66B 23/024 198/330 |
| 2007/0045082 | A1 * | 3/2007 | Ishikawa | B66B 23/04 198/330 |

FOREIGN PATENT DOCUMENTS

| | | | | |
|---|---|---|---|---|
| EP | 3473575 | A1 | 4/2019 | |
| EP | 3623336 | * | 3/2020 | B66B 31/00 |

* cited by examiner

BELT-DRIVEN ESCALATOR

FOREIGN PRIORITY

This application claims priority to European Patent Application No. 19208054.7, filed Nov. 8, 2019, and all the benefits accruing therefrom under 35 U.S.C. § 119, the contents of which in its entirety are herein incorporated by reference.

TECHNICAL FIELD OF INVENTION

The present disclosure relates to belt driven escalators.

BACKGROUND OF THE INVENTION

Conventional escalators comprise a set of steps on which passengers stand that are propelled by a drive system to convey the passengers from one place to another (e.g. between floors of a building). The steps are typically connected to an endless step chain made up of multiple chain links that passes over a drive sprocket. The drive sprocket is rotated by the drive system (typically via a drive chain), driving the step chain to pull the steps along (e.g. up or down inclined guide tracks). Each step is carried in a continuous loop by the step chain, carrying passengers from one end of the escalator to the other (e.g. up an incline), before looping back.

Over the lifetime of the escalator, the pins and sockets that connect links of the step chain can become worn, leading to a potentially dangerous elongation of the step chain. It is, therefore, desirable to utilise as few links as possible in a step chain, to reduce the magnitude of wear-induced elongation. However, reducing the number of links reduces ride comfort and requires a larger sprocket to drive the step chain. A larger drive sprocket requires a higher torque from the drive system and takes up additional space, increasing the footprint of the escalator.

Belt-driven escalators are also known in which the step chain is replaced by a drive belt, typically a toothed drive belt, with the escalator steps attached to and pulled by the belt.

SUMMARY OF THE INVENTION

According to a first aspect of the present disclosure there is provided a belt-driven escalator comprising: a plurality of escalator steps arranged to travel along an inclined conveyance path; a drive belt connected to the plurality of escalator steps; a drive system arranged to drive the drive belt so as to propel the plurality of escalator steps along the inclined conveyance path; and a belt support structure comprising at least one belt wheel arranged to support the plurality of escalator steps via the drive belt.

Because the belt wheel(s) of the belt support structure provides support to the escalator steps via the drive belt, the amount of direct step support that is provided to the steps through a step track or support track (e.g. through support rollers of the steps travelling along support tracks) may be reduced or even eliminated in some regions of the conveyance path. Supporting the steps via the belt wheel(s) and the drive belt may produce less friction than alternative step support means as the belt wheel(s) can be larger and can have improved, lower friction bearings, thereby improving the efficiency of the escalator. Reducing the amount of direct support required may also increase step lifetime, by reducing the load (and thus wear) on direct support components (e.g. support rollers) of the escalator steps.

Furthermore, supporting the escalator steps via the drive belt may also reduce the prevalence of regions of high stress in the drive belt and thus increase the belt's service lifetime. For example the belt wheel(s) may provide a greater contact area and a smoother belt curvature in the regions of highest belt tension.

The drive belt may be connected to each step at a single point, e.g. coincident with a direct support member such as a support roller. With no belt support structure, the drive belt extends in substantially straight lines between these connection points. In curved regions of the belt path there will be sharp changes in the direction of the drive belt around each connection point that can lead to localised increased stresses in the belt. However, when the belt wheel supports the escalator steps via the belt, as in examples of the present disclosure, these sharp changes in direction may be mitigated by the belt wheel(s) providing additional point(s) of belt contact or longer regions of belt contact, thereby reducing stresses on the belt and increasing its service life. In some examples the belt wheel(s) may also provide curved support to the belt, further mitigating sharp changes in the direction of the belt.

The escalator may comprise a step track along which the steps are arranged to travel during passenger conveyance. The step track may define the conveyance path. Each step may comprise a step roller arranged to roll on the step track. Optionally, the escalator comprises two parallel step tracks and each step comprises two corresponding step rollers one on each of the opposite sides of the step. Using two step tracks may help to keep the steps level during passenger conveyance.

The escalator may comprise a support track (different to the step track) by which each step may be directly supported (e.g. via a support component of the step such as a roller or a bushing) as they travel along the conveyance path. The support track may extend along the entire conveyance path and may extend parallel to the step track in at least some regions (e.g. in an inclined region).

The step track, the support track and each step (e.g. a step roller and a support roller of each step) may be arranged such that each step (e.g. a tread surface of each step) is oriented horizontally throughout passenger conveyance along the conveyance path to ensure comfort and safety. In some examples therefore the step tracks and support tracks may diverge (i.e. not extend parallel) in at least some regions of the conveyance path. For example, the support track and the step track may diverge in a transition region, e.g. where the steps transition between an inclined path and a horizontal path. In some examples, the step roller may be positioned in an upper region of the step (e.g. at the top of the step), and the first support component may be positioned in a lower region of the step (e.g. at the bottom of the step).

The drive belt may be connected to the steps such that it passes through an axis of rotation of a support roller (e.g. the axis may pass halfway through a thickness of the drive belt). Arranging the support roller such that its rotation axis is near to or aligned with the centre of drive force may reduce or even eliminate the application of off-axis forces (i.e. a moment) to the support roller.

The belt support structure may be arranged to at least partially unload the step track and/or support track (and any corresponding step rollers and/or support rollers) at at least one point on the conveyance path (e.g. over a particular region of the conveyance path). In the case of partial unloading of the step track and/or support track, the load may be shared between the track(s) and the belt support structure. The belt support structure may be arranged to fully unload the tracks/rollers by lifting the steps entirely away from the step track(s) and/or support track(s), so that the step rollers and/or support rollers do not make contact with the step track(s) and/or support track(s). It will be appreciated that in such examples portions of the step track(s) and or support track(s) may be omitted in order to save materials and costs where they do not provide any support function owing to the support being provided instead by the belt support structure.

The conveyance path may comprise at least one non-inclined region (i.e. a region in which the steps travel substantially parallel to the ground). For example, the conveyance path may comprise a non-inclined landing region at one or both ends of the conveyance path to facilitate passenger embarkation or disembarkation from the escalator. In some such examples, the conveyance path may comprise a transition region between the inclined region and the landing region in which the steps transition from travelling at an incline to travelling parallel to the ground in the non-inclined landing region. In such examples, the step track and/or the support track may comprise an inclined section, a non-inclined landing section and a curved transition section corresponding to the transition region to facilitate a smooth transition between inclined and horizontal travel of the steps.

In such a transition region, the drive belt undergoes a change in direction between successive steps. In the upper transition region this results in an increased load on each step (e.g. through the step roller and/or support roller) due to the tension forces exerted on each step from the drive belt having a component pointing into the curve of the transition region (i.e. urging the steps into the step tracks and/or support tracks). Preferably, therefore, the belt support structure is arranged to provide support to the steps in an upper transition region.

Without a belt support structure, providing adequate support to the steps in the upper transition region requires strength in either the step track(s) and/or support track(s). If this strength (usually provided by thicker material) is provided throughout the length of the tracks then the tracks will be unnecessarily strong elsewhere (e.g. in an inclined region where the belt does not change direction and where the step may not require as much support). Alternatively, the step track(s) and/or support track(s) may have a complex structure which provides varying amounts of strength in different regions (e.g. increased strength in the transition region), adding to manufacturing expense. In addition, without a belt support structure, the component(s) by which the steps contact the step track(s) and/or support track(s) (e.g. step rollers/support rollers) need to be built to handle the larger forces arising in the transition region, despite only actually experiencing this force over a small section of the entire conveyance path. Therefore, arranging the belt support structure to provide support to the steps in an upper transition region allows the step track(s) and/or support track(s), and the step rollers and/or support rollers to be simplified and optimised to provide only the amount of support required in other sections of the conveyance path, with the support "shortfall" in the upper transition region being made up by the belt support structure. This may reduce costs, weight and manufacturing complexity. For example, by providing extra support where required with the belt support structure, the step track(s) and/or support track(s) may be made thinner, saving material and cost.

In some examples, the belt support structure may comprise a single belt wheel. However, in some examples the belt support structure may comprise a plurality of coplanar belt wheels (e.g. two, three or more). Using a plurality of coplanar belt wheels allows support to be provided over a greater length of the drive belt and/or allows curved support to be provided with a large radius of curvature without requiring an impractically large belt wheel (e.g. one that would not fit beneath the steps of the escalator). Belt wheels are considered to be coplanar when they all lie and rotate within the same plane, i.e. the plane of the belt, i.e. with their axes of rotation all being perpendicular to the plane in which they lie.

The belt support structure may comprise a frame on which the at least one belt wheel is rotatably mounted. The at least one belt wheel is preferably rotatably mounted via a bearing (e.g. a ball bearing), to reduce friction. The frame may be directly mounted on a truss of the escalator.

In examples where the belt support structure is arranged to provide support in a curved upper transition region, the belt support structure may be arranged to provide similarly curved support to the drive belt. In the case of a single belt wheel, the curve is simply defined by the radius of curvature of the single belt wheel. In the case of more than one belt wheel, as the belt passes over the belt wheel(s), the curve of the belt is defined by the envelope of the belt wheel(s) that it comes into contact with, running around and at a tangent to each belt wheel in turn.

In some such examples, the belt support structure may comprise a single circular belt wheel arranged to contact and thus support the drive belt along an arc of the wheel. In some other examples, a plurality of coplanar belt wheels may be arranged to provide curved support to the drive belt, wherein the constituent belt wheels are arranged to contact and thus support the drive belt at points that lie along a curve. The curve may comprise an arc of a circle. The plurality of coplanar belt wheels may be arranged to replicate the curved support provided by a single belt wheel with a larger radius. For example, the belt support structure may be arranged to provide curved support along a curve comprising a radius of curvature of 0.5 m or more (e.g. of approximately 1 m or more).

The curve of the curved support may be chosen to be substantially the same as the curve of a transition region, to provide consistent support to the steps as they travel through the transition region. For example, the transition region of the conveyance path may comprise a curve with a certain radius of curvature (e.g. an arc with a certain radius) and the plurality of coplanar belt wheels may be arranged such that the individual belt wheels provide support to the drive belt at points that lie along an at least approximately matching curve (e.g. an arc with approximately the same radius). Alternatively, the radius of a single belt wheel may be selected to be approximately equal to the radius of curvature of such a curved transition region.

In some examples the drive belt may be toothed (i.e. the drive belt may comprise a plurality of teeth) and the drive system may comprise a drive sprocket arranged to engage with (the teeth of) the drive belt. The use of a toothed drive belt in conjunction with a drive sprocket may enable a high amount of drive force to be transmitted from a drive motor to the escalator steps. The use of teeth may also reduce or avoid slippage. The drive belt may comprise a substantially flat belt, i.e. with a width that is greater than its thickness (width being the dimension perpendicular to the direction of drive and parallel to the axis of rotation of the drive sprocket).

In some examples the at least one belt wheel may also comprise a sprocket arranged to engage with the drive belt. This may help to ensure that the belt is supported evenly and avoids creating unnecessary stresses in the drive belt. In some examples, however, the or each belt wheel may comprise a pulley.

The drive belt may comprise a polyurethane and/or rubber material, such as ethylene propylene rubber (EPDM). The drive belt may comprise reinforcing longitudinal strands (e.g. comprising steel, stainless steel, carbon and/or aramid fibre). The reinforcing strands may be embedded in the polyurethane and/or rubber material of the drive belt.

Each step may comprise a tread surface on which passengers stand whilst they are conveyed. The tread surface preferably comprises an upper surface of the step (i.e. an upper surface whilst the step is carrying passengers—the steps may loop back in a different orientation). The tread surface is preferably substantially planar, although it may comprise a series of ridges or grooves extending perpendicular to the surface.

As mentioned above, to provide a safe and comfortable ride to passengers, the escalator is preferably arranged such that the tread surface of each step maintains a constant orientation (e.g. horizontal) throughout passenger conveyance. In some examples, this may require the orientation of the step to change relative to the drive belt during operation, for example as the steps transition from an inclined region of the escalator to a flat (i.e. horizontal) landing region of the escalator. In some examples, therefore, the drive belt is rotatably connected to each step (i.e. such that it can rotate about an axis perpendicular to the direction of drive but parallel to a tread surface). Connecting the belt such that it can rotate relative to each step enables the drive direction of the belt to change without changing the orientation of the step. For example, rotatably connecting the drive belt enables the steps to be driven along a curved transition region whilst the step's orientation remains constant relative to the ground (e.g. with a tread surface of the step remaining horizontal).

The escalator may comprise a single drive belt (e.g. connected to the steps at a point at or near to their middle (in a direction perpendicular to the direction of travel)). A single drive belt may comprise one unitary belt structure, but in some examples, a single drive belt may comprise two or more connected parallel sub-belts. In such examples, the at least one belt wheel is arranged to support the plurality of escalator steps via both sub-belts. The sub-belts may be separated by and joined together via a series of belt rollers. The at least one belt wheel may comprise a central groove to accommodate the belt rollers while the sub-belts engage with the belt wheel.

However, in some examples the escalator may comprise multiple drive belts (e.g. two) that are all separately connected to the plurality of steps and driven by the drive system. Each drive belt may comprise sub-belts as discussed above. Using multiple drive belts (e.g. two) may increase the load capacity of the escalator and/or provide redundancy in case of damage or breakage to one of the drive belts. When multiple drive belts are used, it is preferable for them to provide a symmetric drive force to each step. For example, the escalator may comprise a first drive belt connected towards one side of the plurality of steps and a second drive belt connected towards the other side of the plurality of the plurality of steps.

In examples featuring a plurality of drive belts, the escalator may also comprise a corresponding plurality of belt support structures arranged, i.e. one to support each belt. Alternatively, a single belt support structure may comprise a common frame on which a plurality of belt wheels or sets of coplanar belt wheels are provided, with each belt wheel or set of coplanar belt wheels arranged to provide support to a different belt of the plurality of belts.

The use of a plurality of belt wheels to provide curved support is believed to be independently inventive. From a second aspect of the present disclosure, therefore, there is provided a belt support structure for supporting an escalator drive belt, the support structure comprising at least three coplanar belt wheels arranged to provide curved support to the escalator drive belt.

Features of the belt support structure described in relation to the first aspect of the present disclosure may of course also be applied to this second aspect. In general, features of any example described herein may be applied wherever appropriate to any other example described herein. Where reference is made to different examples or sets of examples, it should be understood that these are not necessarily distinct but may overlap.

BRIEF DESCRIPTION OF THE DRAWINGS

Certain examples of the present disclosure will now be described with reference to the accompanying drawings in which.

DETAILED DESCRIPTION

Figure 1:
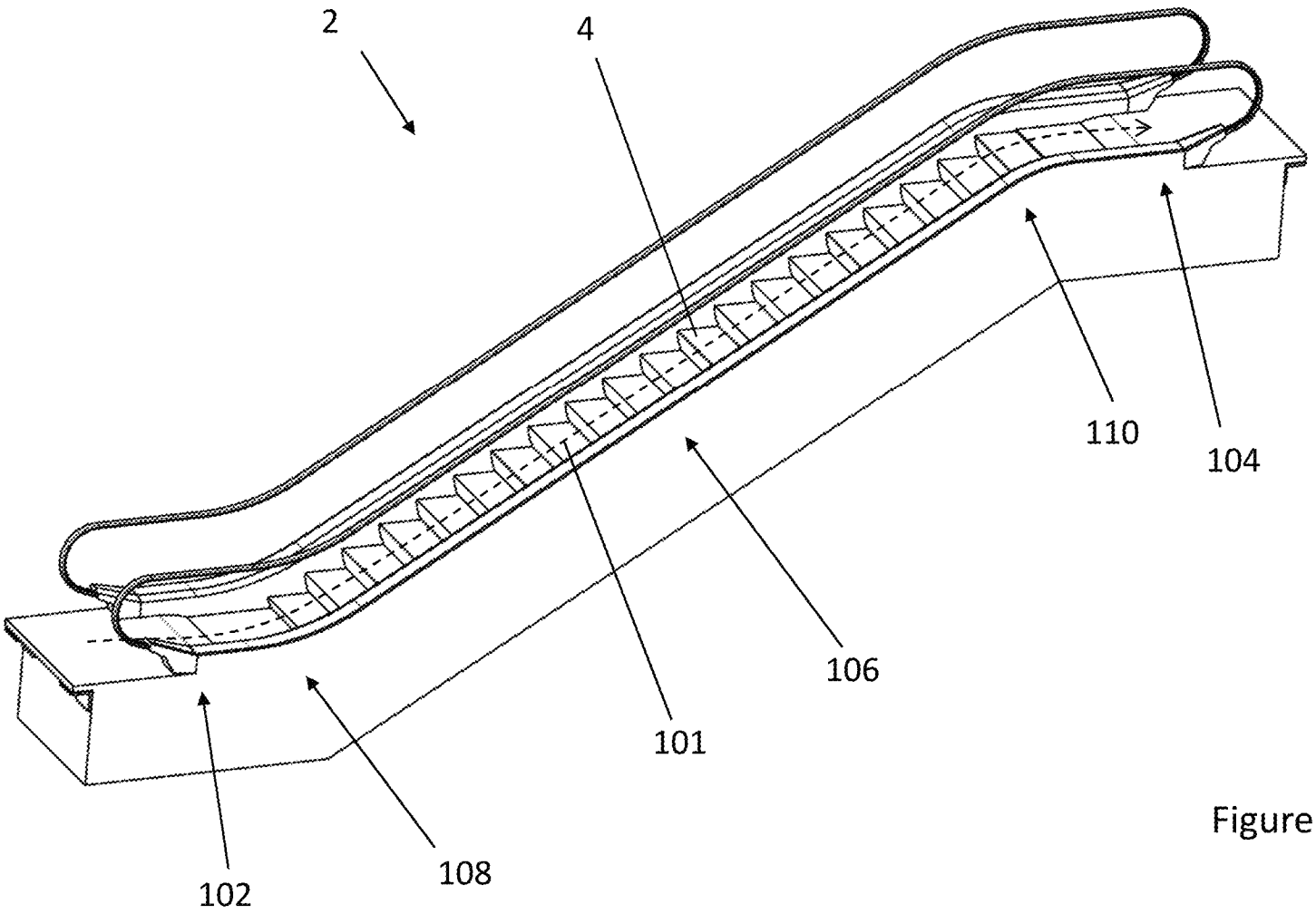
FIG. 1 shows an escalator according to an example of the present disclosure.
Figure 2:
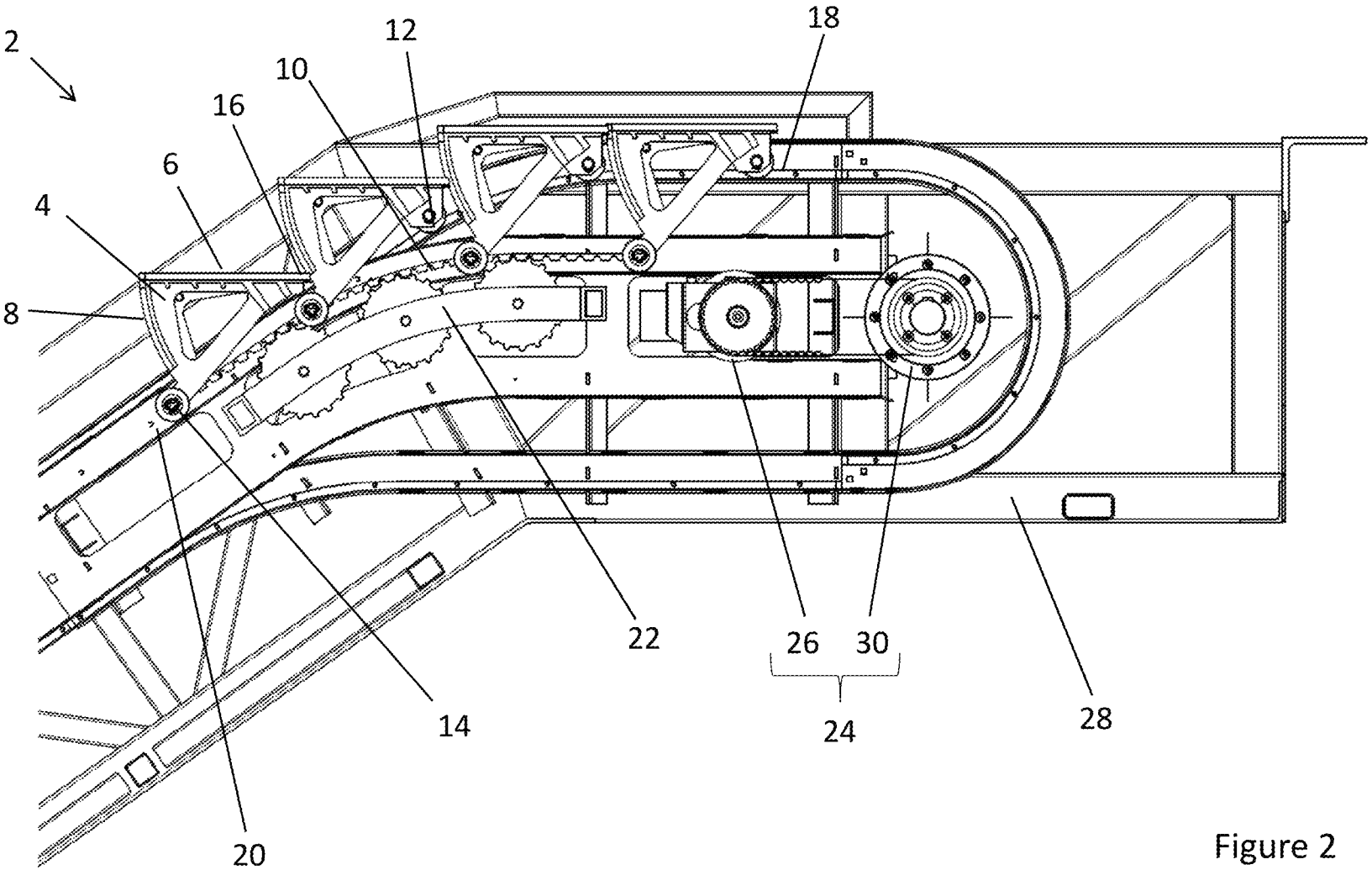
FIG. 2 shows a cross-section view of an upper part of the escalator.
Figure 3:
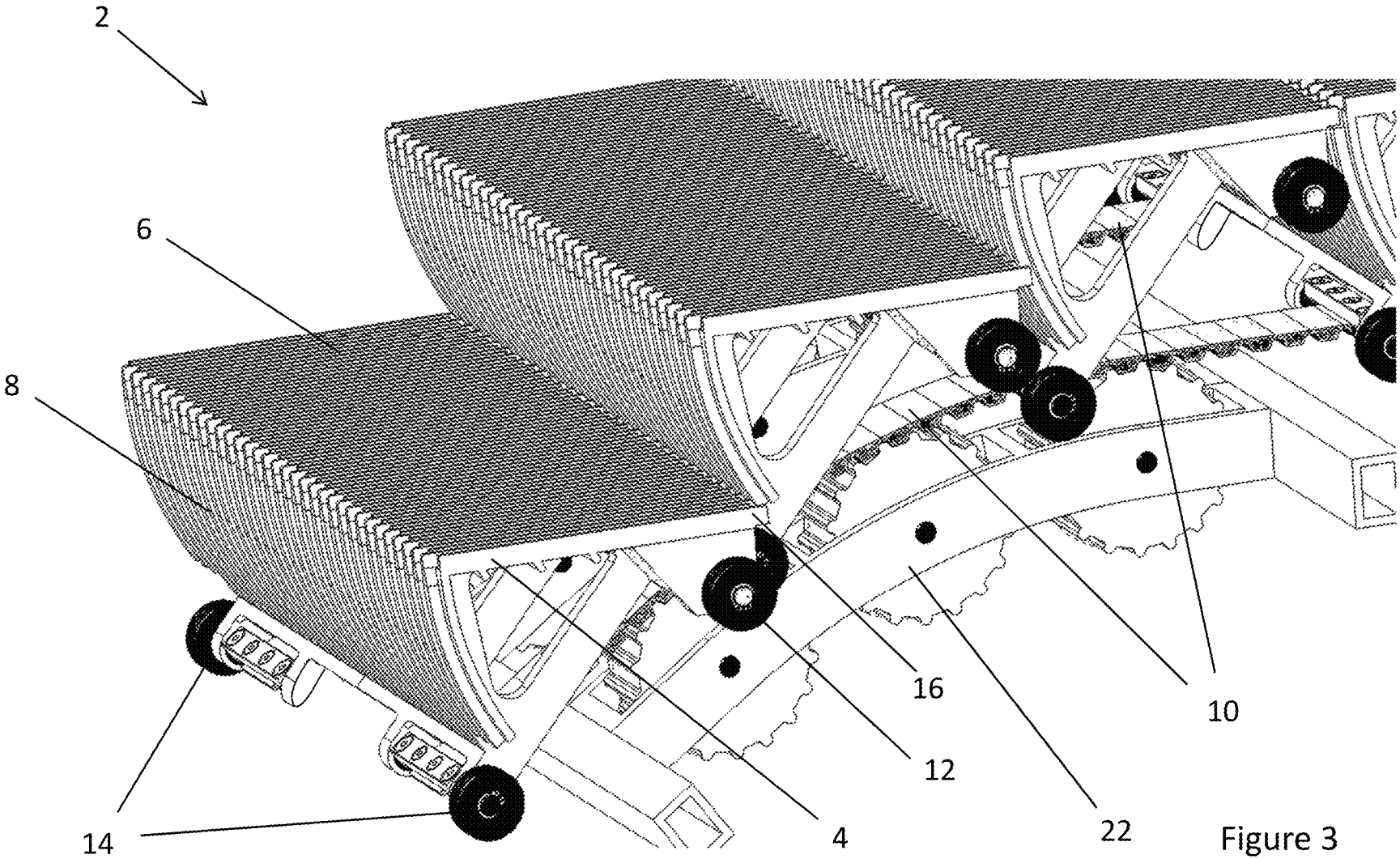
FIG. 3 shows a partial cutaway view of the escalator.
Figure 4:
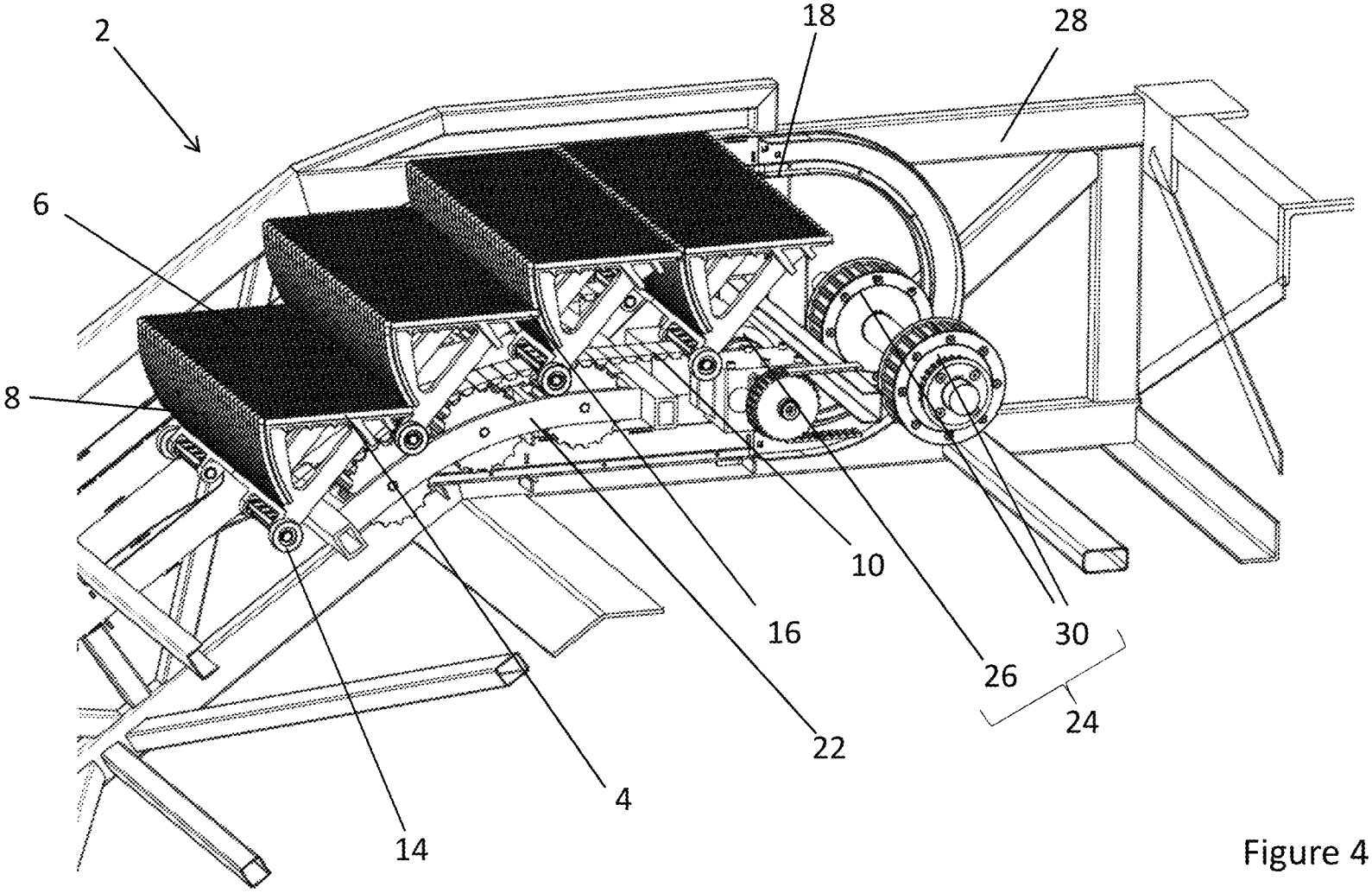
FIGS. 4 to 7 show further partial cutaway views of the escalator.
Figure 5:
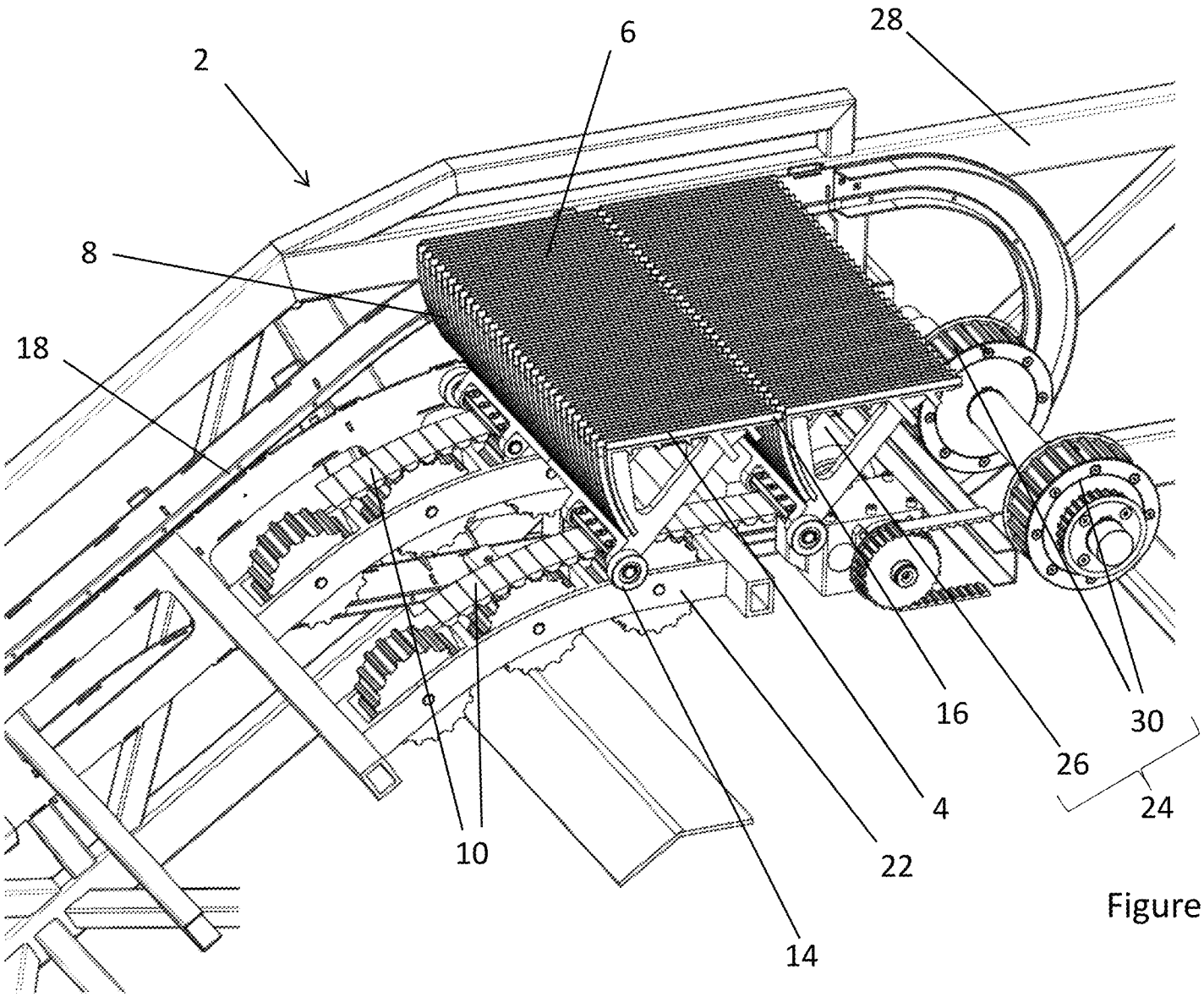
Figure 6:
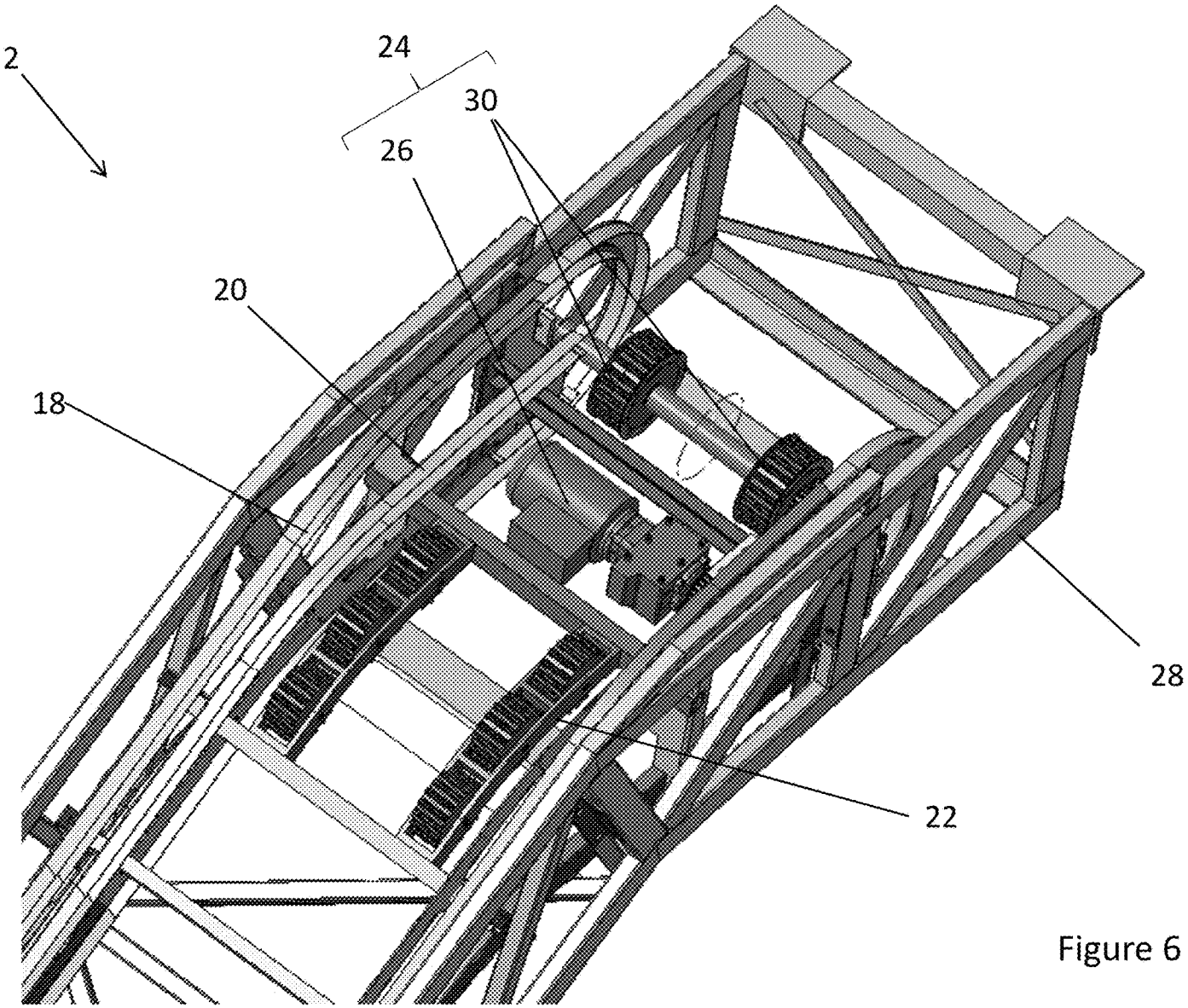
Figure 7:
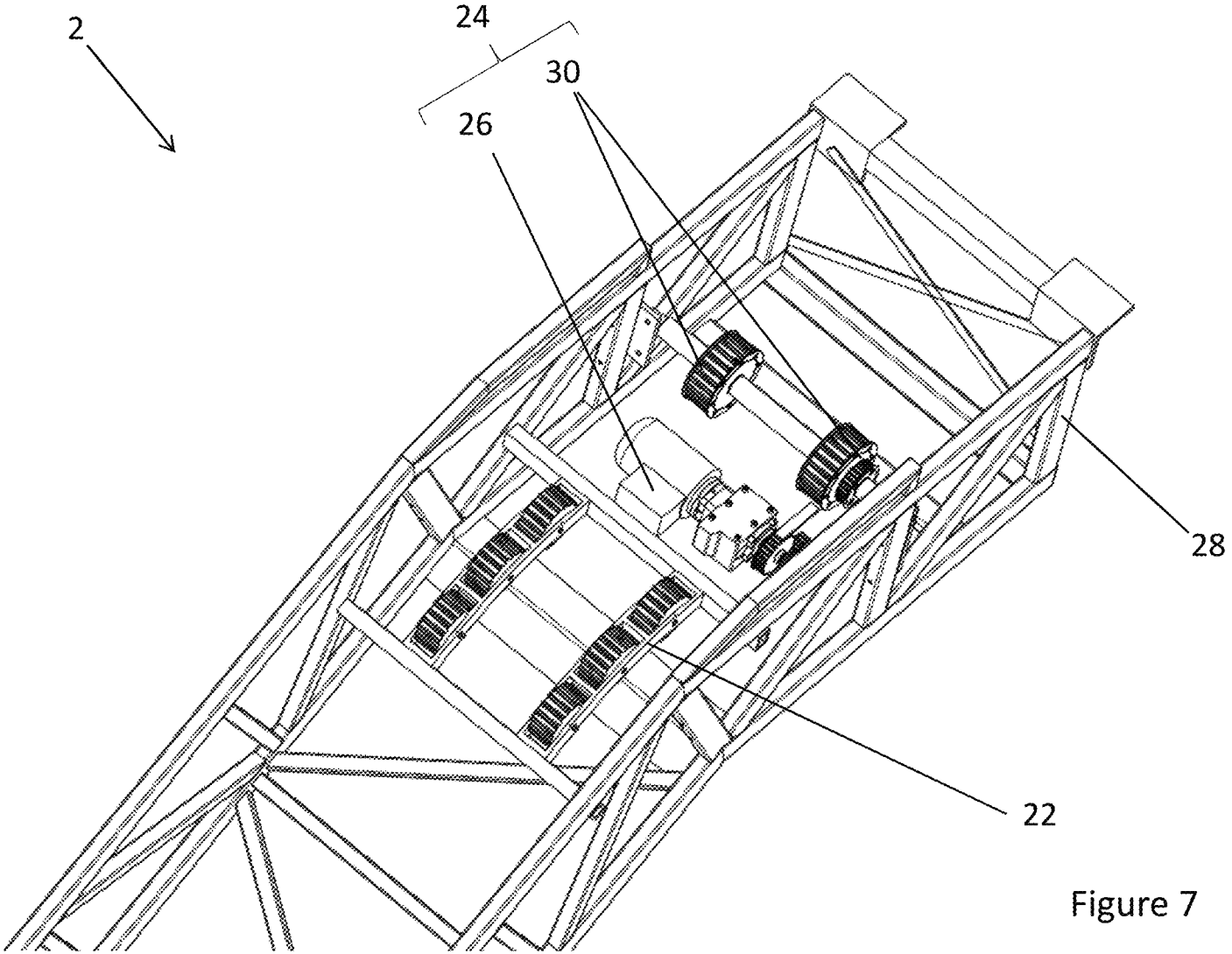

FIG. 1 shows a belt driven escalator 2 comprising a plurality of escalator steps 4 arranged to travel along an escalator conveyance path 101 to convey passengers. The conveyance path 101 comprises a lower landing region 102, an upper landing region 104 and an inclined region 106 located between the landing regions 102, 104. The conveyance path 101 comprises a lower transition region 108 between the inclined region 106 and the lower landing region 102 and an upper transition region 110 between the inclined region 106 and the upper landing region 104. In the upper transition region 110, the steps 4 transition from travelling at an incline in the inclined region 106 to travelling parallel to the ground in the non-inclined upper landing region 104.

FIGS. 2-7 show various partial cutaway views of the escalator 2 in the upper transition region 110. Each step 4 comprises a tread surface 6 and a front surface 8. Each step 4 is rotatably connected to two parallel drive belts 10, although only one (e.g. centrally located) belt may be used in other examples. The belts 10 are driven by a drive system 24 to propel the plurality of escalator steps 4 along the conveyance path 101.

Each escalator step 4 comprises a pair of step rollers 12 and a pair of support rollers 14. The tread surface 6 extends from the front surface 8 to a rear edge 16. The step rollers 12 are connected to the step 4 near the rear edge 16, with one step roller 12 at each side of the rear edge 16 (not all step rollers are shown in FIGS. 2-7). The support rollers 14 are connected to the step 4 near the bottom of the front surface 8, with one support roller 14 on each side of each step 4. The drive belts 10 are connected to each step 4 such that the axes of rotation of the support rollers 14 pass through the drive belts 10 when they are connected, to reduce the application of off-axis forces (i.e. a moment) to the support rollers 14.

As the steps are propelled along the conveyance path 101, the step rollers 12 travel along two parallel step tracks 18 and two parallel support tracks 20. The step tracks 18 and support tracks 20 are arranged such that the tread surface 6 of each step 4 remains horizontal (i.e. parallel to the ground) throughout passenger conveyance. For example, in the curved upper and lower transition regions 108, 110 the step tracks 18 and support tracks 20 diverge from one another and are similarly curved to keep the steps 4 level.

As mentioned above, in the upper transition region 110 the steps 4 transition from travelling at an incline to travelling parallel to the ground (when the escalator 2 is operated in an upwards direction; an opposite transition occurs when the escalator 2 is driven in a downwards direction). The tension force in the drive belts 10 in the upper transition region 110 thus has a component which urges the steps 4 (via the support rollers 14) into the support tracks 20. It will be appreciated that in other examples in which the belt is connected to a different location on the step, the tension forces may be applied through the step rollers 12 against the step tracks 18 or indeed through both the step rollers 12 and the support rollers 14 against both the step tracks 18 and support tracks 20.

The step tracks 18 and support tracks 20 (and the step rollers 12 and support rollers 14) could simply be engineered to be strong enough to withstand this additional force in the upper transition region 110. However, this would either cause them to be unnecessarily strong in other regions, or require them to have a complex structure with different levels of strength in different regions. Instead, in this example the escalator 2 comprises a belt support structure 22 in the upper transition region 110 that is arranged to support the escalator steps 4 via the drive belts 10. The belt support structure 22 is arranged to at least partially unload the support tracks 20 (and consequently the support rollers 14) in the upper transition region 110, and may even be arranged to fully unload, i.e. entirely lift the support rollers 14 away from the support tracks 20 in the transition region. The support rollers 14 and support tracks 20 may thus be designed to provide only the support required in other regions of the conveyance path 101, with the belt support structure 22 providing additional support in the upper transition region 110. As discussed above, sections of the support tracks 20 may be omitted in the region where full support is provided by the belt support structure 22. Again, it will be appreciated that in other examples where the belt connection is made to a different part of the step 4, the support provided by the belt support structure 22 may instead partially or fully lift the step rollers 12 from the step tracks 18 or may partially or fully lift both sets of rollers 12, 14 from both tracks 18, 20.

Figure 8:
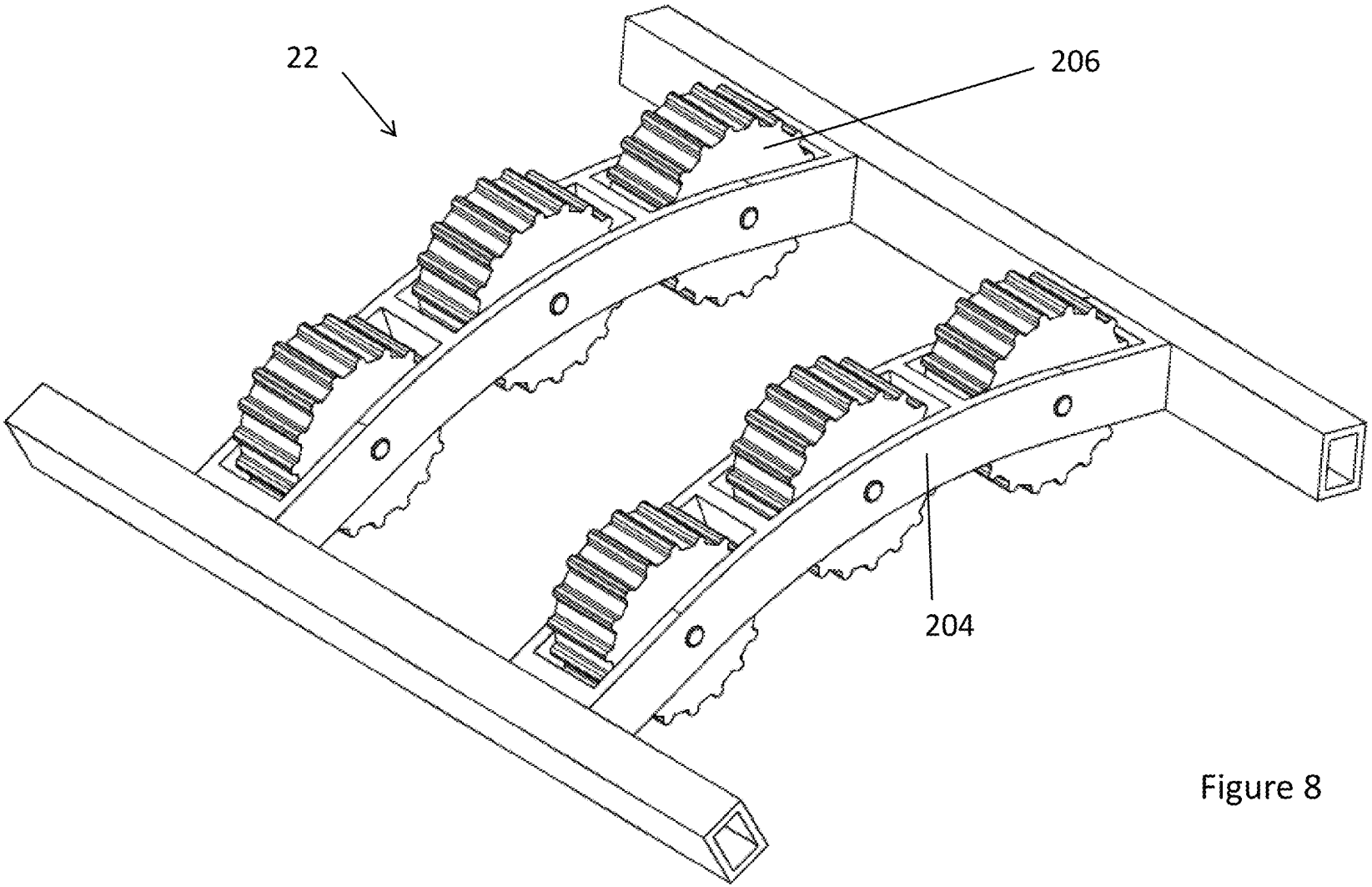
FIG. 8 shows a belt support structure according to an example of the present disclosure.
Figure 9:
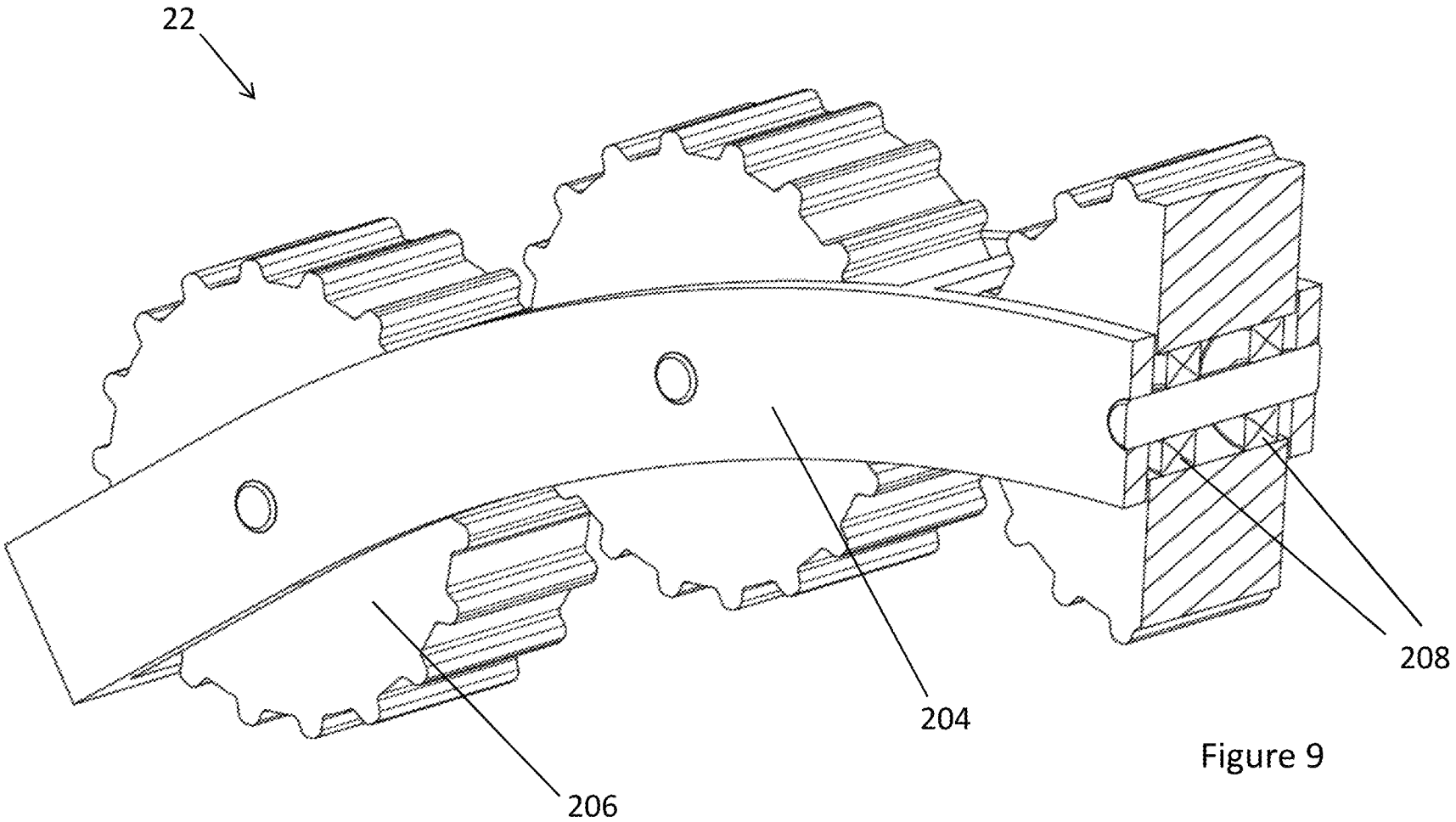
FIG. 9 shows a partial view of the belt support structure.
Figure 10:
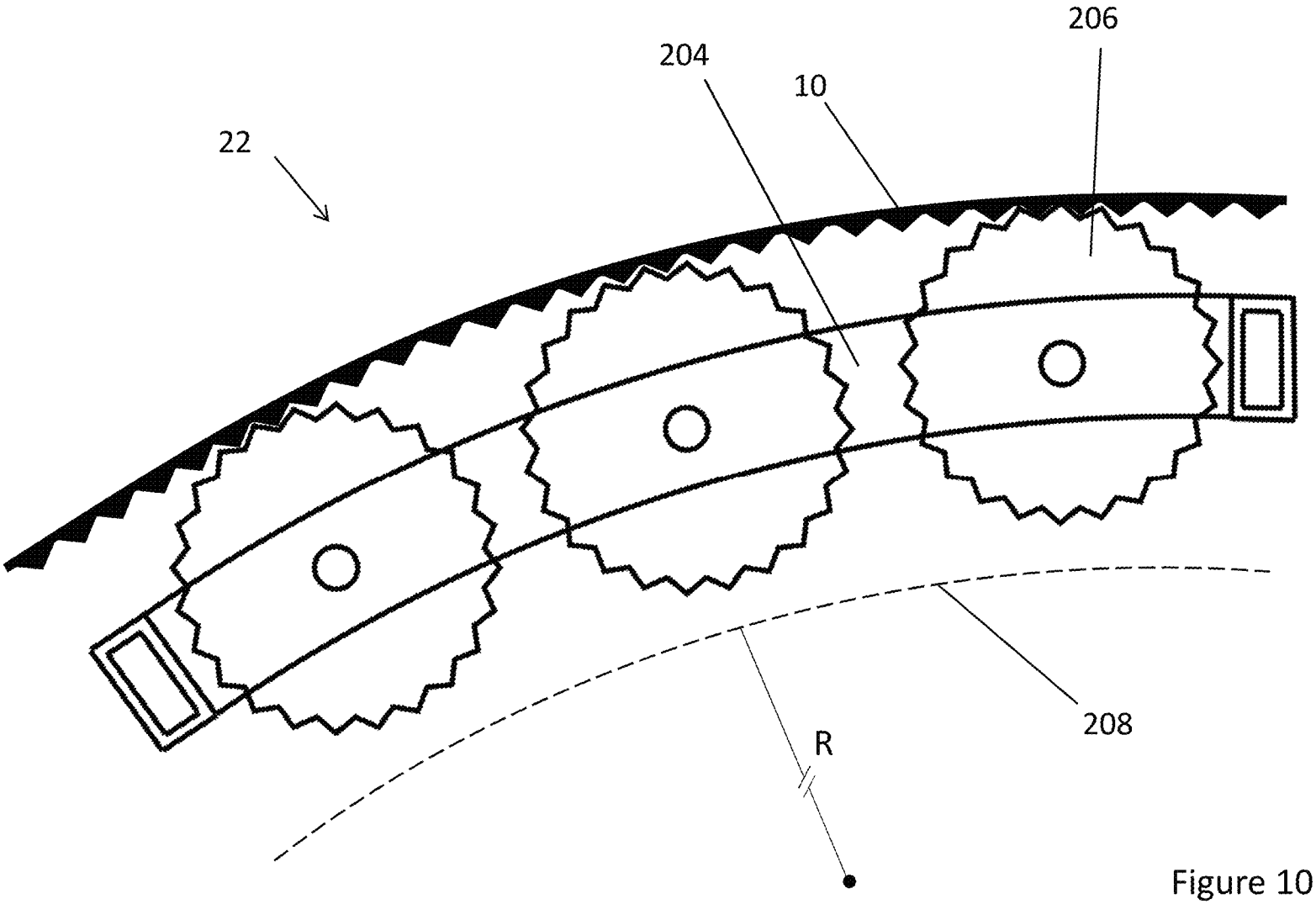
FIG. 10 shows a side view of the belt support structure.

The belt support structure 22, which is shown in more detail in FIGS. 8, 9 and 10, comprises a frame 204 on which six belt wheels 206 are mounted. The belt wheels 206 of the belt support structure 22 are arranged in two parallel groups of three belt wheels 206 for supporting the two drive belts 10 of the escalator 2 (i.e. one group of three belt wheels 206 for each belt 10). However, other configurations are possible, e.g., comprising a single belt wheel 206 or group of belt wheels 206 for supporting a single drive belt 10. As shown in FIGS. 8, 9 and 10, the belt wheels 206 are all the same size (i.e. the same radius), and are mounted to the frame 204 which is curved so as to match the curve of the transition region 110. Therefore the envelope of the belt wheels 206 also matches the curve of the transition region 110 and therefore provides the appropriate support shape for the drive belt 10 in the transition region 110 even though the support rollers 14 are not in contact with the support tracks 20 in this region. Accordingly the steps 4 are maintained in their appropriate horizontal orientation as required.

The belt wheels 206 are toothed (i.e. they comprise sprockets) to engage with and provide even support to the toothed drive belts 10. In each group of three belt wheels 206, the belt wheels 206 are coplanar (i.e. they are aligned in a common plane perpendicular to their axes of rotation), to provide support over a greater length of the drive belt 10 than could be provided by a single belt wheel 206 of the same radius. However, in some examples a single belt wheel 206 may be used (e.g. with the same and/or a larger radius).

The belt wheels 206 in each group are arranged to provided curved support to a drive belt 10, i.e. the points at which the drive belt 10 contacts the belt wheels 206 when being supported thereby defines a curve. The curve of the belt wheels 206 matches the curve of the transition region 110 of the conveyance path 101 to ensure even support of the belts 10 as the steps 4 travel through the transition region 110 and thus provide a smooth ride for passengers of the escalator 2. For example, the transition region 110 and the curve of the belt wheels 206 may both comprise an arc 208 of a circle with radius R (shown in FIG. 10).

As shown in FIG. 9, each belt wheel 206 is rotatably mounted to the frame 204 by a pair of bearings 208.

In this example, all of the belt wheels 206 have the same width (in a direction parallel to their axes of rotation) and the same radius. Because the belt wheels 206 in this example have the same radius, their axes of rotation also define a curve matching arc 208.

FIGS. 2-7 show various partial cutaway views of the belt driven escalator 2, in which many of the components of the escalator 2 (e.g. including the steps 4 and the drive belts 10 in FIGS. 6 and 7) have been omitted to allow the depiction of other components. The escalator 2 further comprises a truss 28 that provides the overall structure of the escalator 2. The step tracks 18 and support tracks 20, and the belt support structure 22 are rigidly attached to the truss 28. The escalator 2 also comprises a drive system 24. The drive system 24 comprises a motor 26 that is coupled to two drive sprockets 30. The drive sprockets 30 are configured to engage the drive belts 10. The motor 26 drives the drive sprockets 30 to rotate, thus driving the drive belts 10 to propel the steps 4 along the conveyance path 101. The drive system 24 is a direct drive system, compact enough to be located underneath the upper landing region 104 of the conveyance path 101. This reduces the footprint of the escalator 2.

Figure 11:
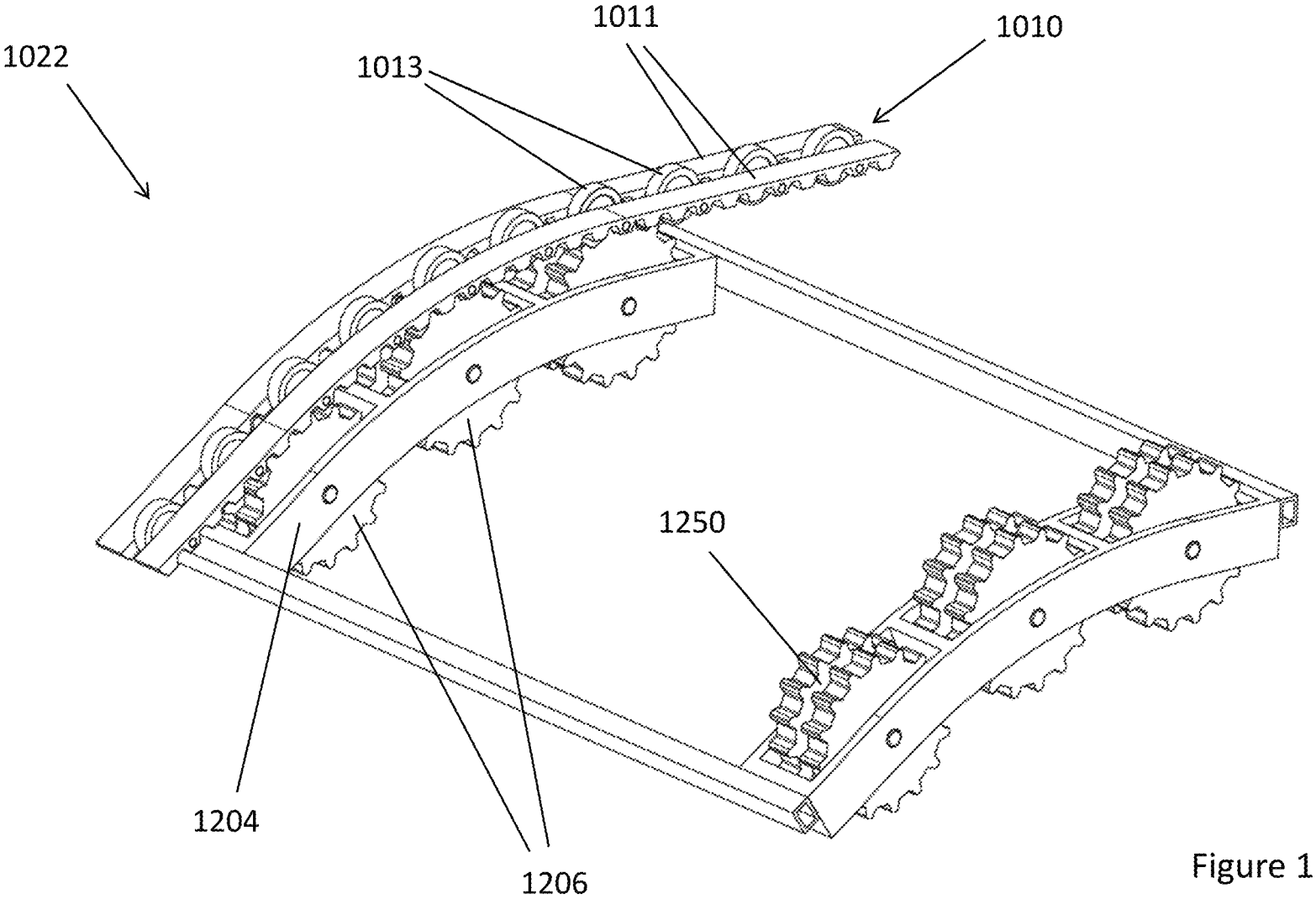
FIG. 11 shows a belt support structure according to another example of the present disclosure.
Figure 12:
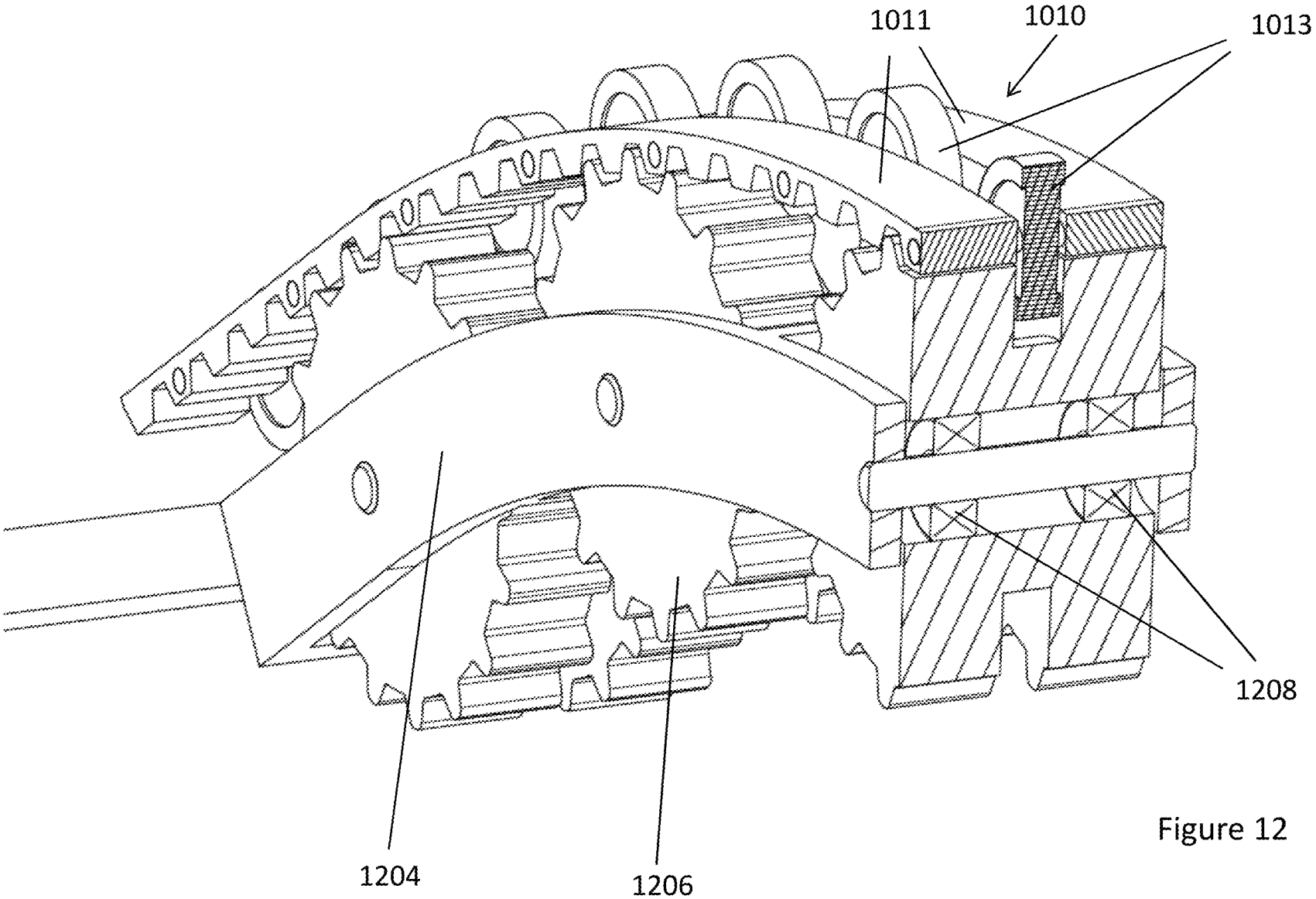
FIG. 12 shows a partial view of the belt support structure of FIG. 11.

FIGS. 11 and 12 show an alternative belt support structure 1022. The belt support structure 1022 comprises a frame 1204 on which six belt wheels 1206 are mounted. The belt wheels 1206 of the belt support structure 1022 are arranged in two parallel groups of three belt wheels 1206 for supporting two drive belts 1010 (only one belt 1010 is shown in FIG. 11) of an escalator (i.e. one group of three belt wheels 1206 for each belt 1010). Each drive belt 1010 comprises two parallel sub-belts 1011, separated by and joined together via a series of belt rollers 1013. Each belt wheel 1206 comprises a central groove 1250 to accommodate the belt rollers 1013 as the belt 1010 passes over the belt wheels 1206.

As shown in FIG. 12, each belt wheel 1206 is rotatably mounted to the frame 1204 by a pair of bearings 1208.

While the disclosure has been described in detail in connection with only a limited number of examples, it should be readily understood that the disclosure is not limited to such disclosed examples. Rather, the disclosure can be modified to incorporate any number of variations, alterations, substitutions or equivalent arrangements not heretofore described, but which are commensurate with the scope of the disclosure. Additionally, while various examples of the disclosure have been described, it is to be understood that aspects of the disclosure may include only some of the described examples. Accordingly, the disclosure is not to be seen as limited by the foregoing description, but is only limited by the scope of the appended claims.

What is claimed is:

1. A belt-driven escalator (2) comprising:

a plurality of escalator steps (4) arranged to travel along an inclined conveyance path (101);

a drive belt (10, 1010) directly and rotatably connected to the plurality of escalator steps (4);

a drive system (24) arranged to drive the drive belt (10, 1010) so as to propel the plurality of escalator steps (4) along the inclined conveyance path (101);

a belt support structure (22, 1022) comprising at least one belt wheel (206, 1206) arranged to support the drive belt (10, 1010) so as to support the plurality of escalator steps (4);

a step track (18) along which the steps (4) are arranged to travel during passenger conveyance;

wherein the belt support structure (22, 1022) is arranged to unload the step (4) and/or a support track (20) at at least one point on the conveyance path (101);

wherein the belt support structure (22, 1022) is arranged to lift the steps (4) entirely away from the step track (18) and/or the support track (20) at at least one point on the conveyance path (101).

2. The belt-driven escalator (2) as claimed in claim 1, wherein the conveyance path (101) comprises an upper transition region (110) between an inclined region (106) and a non-inclined landing region (104), and the belt support structure (22, 1022) is arranged to provide support to the steps (4) in the upper transition region (110).

3. The belt-driven escalator (2) as claimed in claim 2, wherein the belt support structure (22, 1022) is arranged to provide curved support to the drive belt (10, 1010) in the upper transition region (110).

4. The belt-driven escalator (2) as claimed in claim 3, wherein the belt support structure (22, 1022) is arranged to provide curved support to the drive belt (10, 1010) with a curve that matches a curve of the upper transition region (110).

5. The belt-driven escalator (2) as claimed in claim 4, wherein the curve of the upper transition region (110) comprises a radius of curvature of at least 0.5 m.

6. The belt-driven escalator (2) as claimed in claim 1, wherein the belt support structure (22, 1022) comprises a single belt wheel (206, 1206).

7. The belt-driven escalator (2) as claimed in claim 1, wherein the belt support structure (22, 1022) comprises a plurality of coplanar belt wheels (206, 1206).

8. The belt-driven escalator (2) as claimed in claim 1, wherein the at least one belt wheel (206, 1206) is mounted via a ball bearing.

9. The belt-driven escalator (2) as claimed in claim 1, wherein the drive belt (10, 1010) is toothed and the at least one belt wheel (206, 1206) comprises a sprocket arranged to engage with the toothed drive belt (10, 1010).

* * * * *